US008373056B2

(12) United States Patent
Dejima

(10) Patent No.: US 8,373,056 B2
(45) Date of Patent: Feb. 12, 2013

(54) WAVEFORM GENERATION APPARATUS AND WAVEFORM GENERATION PROGRAM

(75) Inventor: Tetsuya Dejima, Hamura (JP)

(73) Assignee: Casio Computer Co., Ltd, Tokyo (JP)

( * ) Notice: Subject to any disclaimer, the term of this patent is extended or adjusted under 35 U.S.C. 154(b) by 149 days.

(21) Appl. No.: 13/046,995

(22) Filed: Mar. 14, 2011

(65) Prior Publication Data

US 2011/0226116 A1 Sep. 22, 2011

(30) Foreign Application Priority Data

Mar. 17, 2010 (JP) ..... 2010-060374

(51) Int. Cl.
*G10H 3/00* (2006.01)

(52) U.S. Cl. ..... 84/647; 327/334; 84/671

(58) Field of Classification Search ..... 84/647, 84/671; 327/334
See application file for complete search history.

(56) References Cited

U.S. PATENT DOCUMENTS 7,069,217 B2 * 6/2006 McLaughlin et al. ..... 704/269
7,124,075 B2 * 10/2006 Terez ..... 704/203
2001/0018652 A1 * 8/2001 McLaughlin et al. ..... 704/233
2003/0088401 A1 * 5/2003 Terez ..... 704/207
2004/0050999 A1 * 3/2004 Hill et al. ..... 244/17.27
2011/0226116 A1 * 9/2011 Dejima ..... 84/604

FOREIGN PATENT DOCUMENTS

JP 09146915 6/1997
JP 11175503 7/1999
JP 2008275845 11/2008
JP 2008275845 A * 11/2008
JP 2009069715 A * 4/2009

* cited by examiner

*Primary Examiner* — David S. Warren
(74) *Attorney, Agent, or Firm* — Turocy & Watson, LLP

(57) ABSTRACT

In a waveform generation apparatus, a coordinates information group showing original waveform data in a two-dimensional phase space having a time axis and a wave height value axis is expanded to an n-dimensional phase space (n>2) including a time axis and a wave height value axis using Takens' embedding theorem, and converted to a coordinates information group showing attractor data. In addition, an area of the attractor data is shown, and after one of the coordinates information is specified from the coordinates information group within the shown area, coordinate values corresponding to a time axis in the coordinates information are acquired as time information. Then, composite waveform data is generated by a predetermined waveform data being added to the original waveform data, and the generated composite waveform data is outputted from a position of the original waveform data on a time axis corresponding to the acquired time information.

7 Claims, 17 Drawing Sheets

FIG. 14

1401 1402 1410

| X COORDINATE | IDENTIFICATION AREA | WAVE HEIGHT VALUE | ACQUIRED TIME INFORMATION |
|---|---|---|---|
| X(0) | 0 | $W(t_0)$ | |
| X(1) | 0 | $W(t_0+\Delta t)$ | |
| X(2) | 0 | $W(t_0+2\Delta t)$ | |
| ⋮ | ⋮ | ⋮ | |
| X(m) | 0 | $W(t_0+m\Delta t)$ | |
| ⋮ | ⋮ | ⋮ | |
| X(p-1) | 0 | $W(t_0+(p-1)\Delta t)$ | |
| X(p) | 1 | $W(t_0+p\Delta t)$ | $t_0+p\Delta t$ |
| X(p+1) | 1 | $W(t_0+(p+1)\Delta t)$ | $t_0+(p+1)\Delta t$ |
| ⋮ | ⋮ | ⋮ | ⋮ |
| X(p+q) | 1 | $W(t_0+(p+q)\Delta t)$ | $t_0+(p+q)\Delta t$ |
| X(p+q+1) | 0 | $W(t_0+(p+q+1)\Delta t)$ | |

WAVEFORM GENERATION APPARATUS AND WAVEFORM GENERATION PROGRAM

CROSS-REFERENCE TO RELATED APPLICATION

This application is based upon and claims the benefit of priority from the prior Japanese Patent Application No. 2010-060374, filed Mar. 17, 2010, the entire contents of which is incorporated herein by reference.

BACKGROUND OF THE INVENTION

1. Field of the Invention

The present invention relates to a waveform generation apparatus and a waveform generation program that applies a different waveform to an inputted waveform by taking advantage of attractors used in chaos theory, and thereby generating a new waveform accompanied by resonation and attenuation.

2. Description of the Related Art

Conventionally, when creating music, a musician must first consider how to leave listeners with a strong impression of an image formed in the musician's mind for each song. The process of creating music is largely divided into a "composition" process for optimizing melodies and chords, and a "tone determination" process for optimizing tones used to play the composed melodies and chords. In the "tone determination" process, the musician generally finds a tone that fits an image he wishes to express, and uses it as is. The selected tone has a particularly important role in leaving an impression of the musician's music on listeners.

When performing "tone determination", the musician often extracts "sound impression" which is a feature of sound, or in other words, extracts "sound feature that leaves an impression on people", and actively uses this feature. However, the extraction of "sound impression" has not been established as a common method and is performed based mostly on experience and sensitivity. Therefore, unless the musician is very experienced, this extraction is difficult.

When the musician therefore spends time and effort to extract "sound impression" matching what he is imagining and finds a tone matching this "sound impression", the musician frequently reuses the tone in other songs "composed" later, after using it in a single "composed" song. This is because the discovered "sound impression" is very appealing and valuable to the musician, and finding a replacement tone having a similar "sound impression" is extremely difficult. However, repeatedly reusing the same tone may leave listeners with the negative impression that the musician is simply repeatedly reusing sounds of the same tone and lacks creativity. In addition, the originality of each song is lost, and a crucial problem arises in that listeners lose interest in the musician.

In recent years, it has become known that when a method called Takens' plot, which is considered to be similar to information processing performed in a human brain, is used to generate an attractor from a certain sound, an attractor indicating "sound impression" is generated. The reason for this is becoming clear through the study of the mechanism of the human brain.

First, the human brain receives external stimulus as information, and after perceiving what the stimulus is (extracts the features thereof), stores the information. This cognition is thought to be performed not only based on inputted information, but also by referencing information stored by stimuli received in the past. For example, a scene in a movie that overlaps with a personal past experience sometimes evokes strong emotions. This is because the brain references memories of experiences stored in the past when it perceives the scene from the movie, and perceives the scene as a strong stimulus if an experience having the same features are found in the memory. The same applies to when a person hears a sound that he has heard somewhere in the past and feels familiarity with the sound.

In the method by which the brain performs cognition, the brain does not necessarily perceive by referencing memories of the distant past. The more recent past is also considered to have a significant influence on cognition. In addition, sound which is information related to hearing is also considered to be perceived by more recent past sound being referenced.

From the above, it can be said that the "process of selecting a current waveform by a predetermined plot scale" in Takens' plot is very similar to the process of "simultaneously referencing past information when perceiving current information" performed in the brain. Therefore, to the brain, the process of drawing an attractor from a waveform showing sound by Takens' plot is none other than the process of extracting "sound impression" required to perceive the waveform. In other words, an attractor displayed using Takens' plot visually expresses the characterizing portion of the sound, which is its "sound impression".

For example, a waveform generator having a following configuration is described in Japanese Patent Application Laid-Open (Kokai) Publication No. 2008-275845.

The waveform generator includes a Takens' plot processing means for actualizing embedding of original waveform data in a two-dimensional phase space having a time axis and a wave height value axis to an n-dimensional phase space ($n>2$) based on Takens' embedding theorem by performing Takens' plot processing based on plot conditions composed of a predetermined plot scale value t and a resampling time $\Delta t$, and generating attractor data in the n-dimensional phase space; an attractor displaying means for displaying on a display screen of a display means an attractor trajectory based on the attractor data generated by the Takens' plot processing means; an attractor altering means for generating a variation attractor by altering the shape of a waveform showing the attractor displayed by the attractor displaying means in response to a user operation; and a waveform transformation processing means for generating waveform data in a two-dimensional phase space by performing inverse transformation processing in the Takens' plot processing on the variation attractor generated by the attractor changing means.

By an attractor waveform obtained by Takens' plot being altered and the altered attractor waveform being returned to waveform data in a two-dimensional phase space in this way, music edited by the user can be generated while maintaining the features of the attractor.

On the other hand, as a method of amplifying and attenuating an inputted waveform, a method is conventionally used in which the amplification rate of an inputted waveform is simply changed to perform amplification and attenuation. However, in this method, there is a problem in that only the volume is changed, and the character (tone) of the sound cannot be changed. Therefore, musical sounds having different attributes or musical sounds including harmony cannot be generated.

SUMMARY OF THE INVENTION

The present invention has been conceived to solve the above-described problem. An object of the present invention is to provide a waveform generation apparatus and a waveform generation program that applies a different waveform to an inputted waveform by taking advantage of attractors used in chaos theory, and thereby generating a new waveform accompanied by resonation and attenuation.

In accordance with one concept of the invention, the present invention attaches identification information to an inputted waveform in a portion of an attractor within a certain area defined in an attractor space, and after adding another waveform prepared in advance to the inputted waveform at a timing (time) on a time axis corresponding to the attractor to which the identification information has been attached, outputs it. As a result, the effectiveness of the inputted waveform is enhanced.

In order to achieve the above-described object, in accordance with one aspect of the present invention, there is provided a waveform generation apparatus comprising a Takens' plot processing means for expanding a coordinates information group to show original waveform data upon a two-dimensional phase space having a time axis and a wave height value axis to an n-dimensional phase space (n>2) including a time axis and a wave height value axis by using Takens' embedding theorem, and converting the coordinates information group consecutively to show an attractor data upon the n-dimensional phase space; an area demarcation means for demarcating a predetermined area upon the n-dimensional phase space; a time information acquisition means for acquiring the coordinates information group consecutively that belongs to a demarcated area, specifying one of the coordinates information from among the coordinates information group consecutively acquired and acquiring coordinate values corresponding to the time axis within the coordinates information as time information; and a waveform outputting means for, while outputting the original waveform data, generating and outputting a composite waveform data by adding a predetermined waveform data to the original waveform data from a position of the original waveform data upon the time axis corresponding to the acquired time information.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 14 is a diagram for explaining the acquisition of time information in the identification mark attachment processing according to the embodiment;

DETAILED DESCRIPTION OF THE PREFERRED EMBODIMENTS

Figure 1:
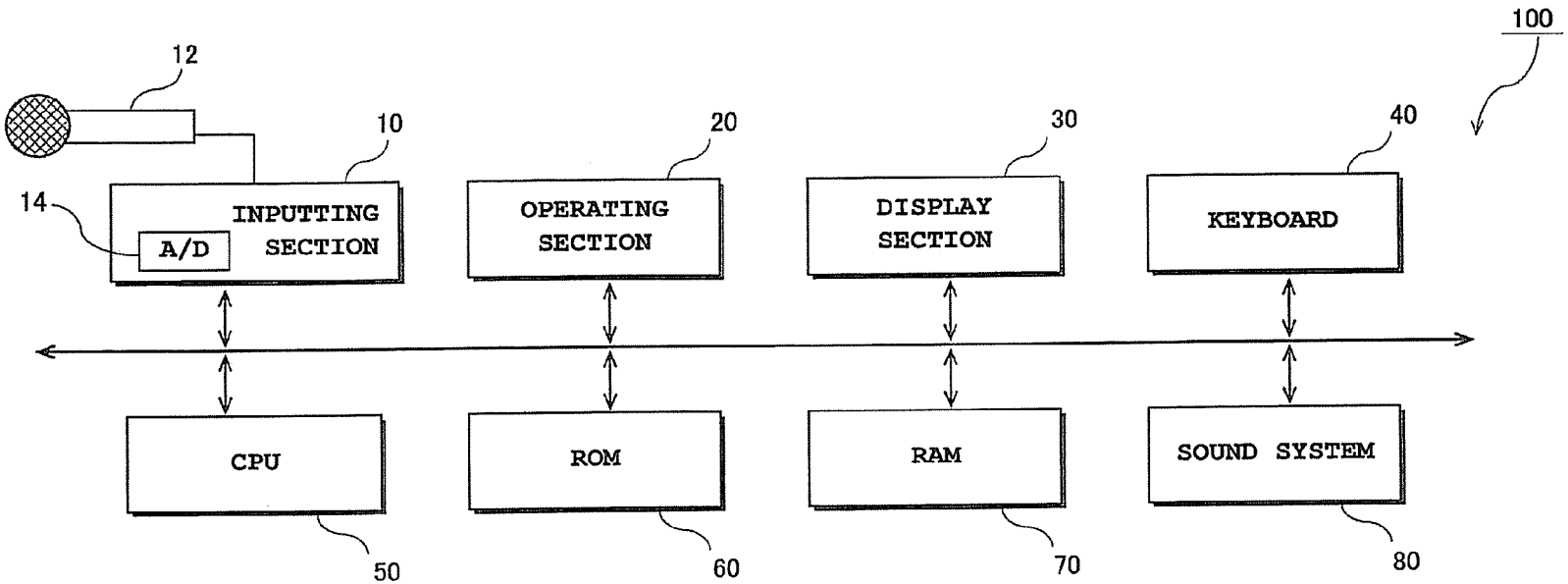
FIG. 1 is a block diagram showing the structure of a waveform generation apparatus according to an embodiment of the present invention.

The present invention will hereinafter be described in detail with reference to the preferred embodiments shown in the accompanying drawings. FIG. 1 is a block diagram showing the structure of a waveform generation apparatus according to an embodiment of the present invention. As shown in FIG. 1, a waveform generation apparatus 100 according to the embodiment includes an inputting section 10, an operating section 20, a display section 30, a keyboard 40, a central processing unit (CPU) 50, a read-only memory (ROM) 60, a random access memory (RAM) 70, and a sound system 80.

Here, the CPU 50 actualizes the functions of a Takens' plot processing means, an area demarcation means, a time information acquisition means, a waveform outputting means, and an attractor image generation means.

The inputting section 10, which has a microphone 12 and an analog-to-digital (A/D) converter 14, samples a waveform inputted from an external source, and generates and outputs original waveform data, under the control of the CPU 50. The original waveform data outputted from the inputting section 10 is stored in an original waveform data area of the RAM 70.

The operating section 20, which includes various switches provided on an operating panel (not shown), generates a switch event in response to a switch operation by a user, and this switch event outputted from the operating section 20 is received by the CPU 50. The switches provided in the operating section 20 include a mode switch for selecting an operation mode, and a waveform selection switch for selecting a waveform to be applied, in addition to a power switch for turning ON and OFF the power. The operating section 20 also includes a mouse:

The display section 30 is, for example, a liquid crystal display device, and an image based on image data generated by the CPU 50 is displayed on a screen thereof. The keyboard 40 has a plurality of keys, and information on key depression, key release, and key depression speed (keyboard information) is provided to the CPU 50. The CPU 50 generates key-ON events and key-OFF events based on the keyboard information; and outputs them to the sound system 80.

The CPU 50 controls each section of the apparatus in accordance with a switch event provided by the operating section 20. For example, the CPU 50 performs predetermined processing in an operation mode selected by the operation of the mode switch included in the operating section 20. For example, in waveform input mode, the CPU 50 instructs the inputting section 10 to start waveform sampling and store the generated original waveform data in the original waveform data area of the RAM 70.

In addition, in waveform generation mode, the CPU 50 performs waveform generation processing to extract an attractor from original waveform data stored in the original waveform data area of the RAM 70 and store its attractor data in the RAM 70. In waveform application mode, the CPU 50, for example, generates and outputs musical sound data which is generated by predetermined new waveform data being added to waveform data stored in the original waveform data area of the RAM 70.

The ROM 60 stores therein various programs, such as control programs for acquiring a switch event and for each section of the apparatus, a processing program for the waveform generation processing, and a processing program for the waveform application processing. The ROM 60 also stores, in a basic at tractor data area, basic attractor data having already-discovered well-known attractor features such as the strange attractor, the torus attractor, and the Lorenz attractor.

The RAM 70 has a work area for temporarily storing parameters, flags, and the like used in various processing operations, an original waveform data area for storing original waveform data outputted from the inputting section 10, an attractor data area for storing attractor data acquired by Takens' plot of original waveform data in the waveform generation processing, and an optimal plot condition data area for storing various data related to optimal plot conditions described hereafter.

The sound system 80 performs digital-to-analog (D/A) conversion on musical sound data generated in the waveform application processing, amplifies the converted musical sound data, and outputs the amplified musical sound data from a speaker as acoustic signals.

Figure 2A:
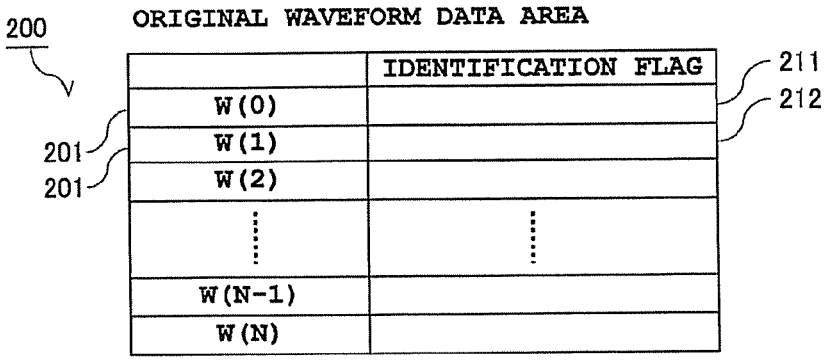
FIG. 2A is a diagram showing an example of original waveform data stored in a original waveform data area of a RAM according to the embodiment.

FIG. 2A is a diagram showing an example of original waveform data stored in the original waveform data area of the RAM according to the embodiment. Original waveform data 200 is constituted by a record including, for example, a series of wave height values W(0), W(1), and so on (see reference numbers 201 and 202) composed of N samples, and identification flags associated with each wave height value (see reference numbers 211 and 212). A plurality of sets of the waveform data 200, such as that shown in FIG. 2A, can be stored in the original waveform data area.

Figure 2B:
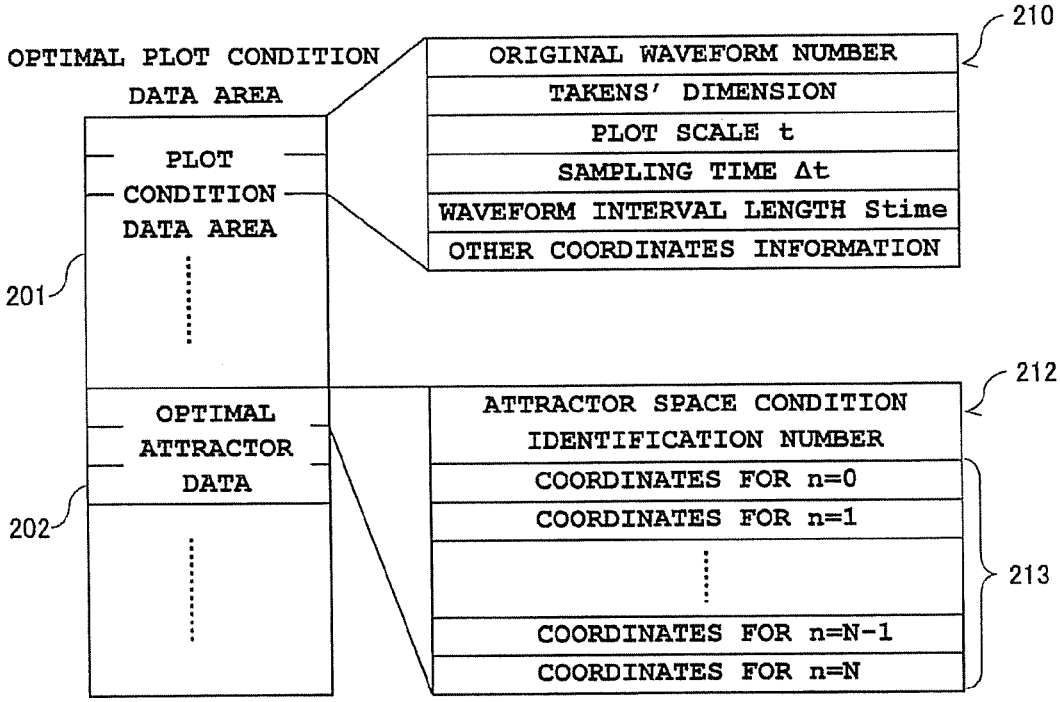
FIG. 2B is a diagram showing an example of an optimal plot condition data area of the RAM according to the embodiment.

FIG. 2B is a diagram of an example of the optimal plot condition data area according to the embodiment. As shown in FIG. 2B, a plot condition data section 201 includes a waveform number for identifying a original waveform that is the base of attractor data that is a optimal plot condition, Takens' dimension, a plot scale width t, a sampling time Δt, a waveform interval length S time, and other coordinate information (such as the unit of coordinate axes used for display, and visual field information) (see reference number 210). An optimal attractor data section 202 has an attractor space condition identification number 212 for identifying data in the plot condition data section 201 related to an attractor, and coordinate values of each attractor data (reference number 213). These coordinate values are similar to a record group (see reference number 301) indicating coordinates described with reference to FIG. 3.

Figure 3:
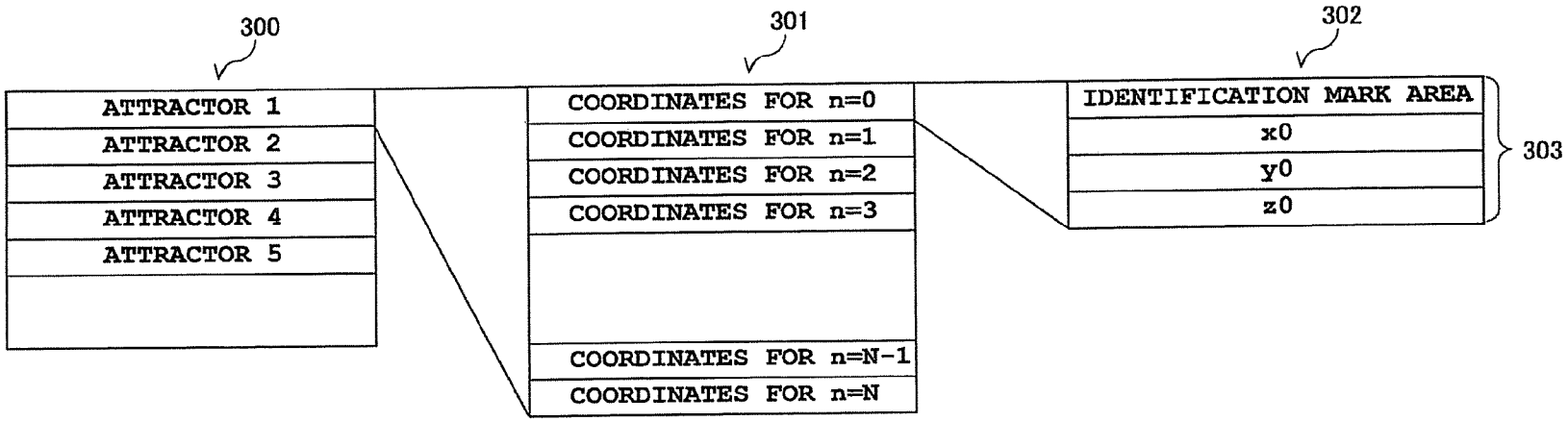
FIG. 3 is a diagram showing an example of attractor data stored in an attractor data area of the RAM according to the embodiment.

FIG. 3 is a diagram showing an example of attractor data stored in the attractor data area of the RAM according to the embodiment. Data groups of a plurality of attractors can be stored in an attractor data area 300. The data group of each attractor includes a record group (see reference number 301) indicating the coordinates of a predetermined dimension (the third dimension according to the embodiment) for each parameter n (for example, n=0 to N). For example, a parameter n=0 includes the records of an identification mark area 302, X-coordinate x0, Y-coordinate y0, and Z-coordinate z0 (see reference number 303). The identification mark area will be described hereafter.

Figure 4:
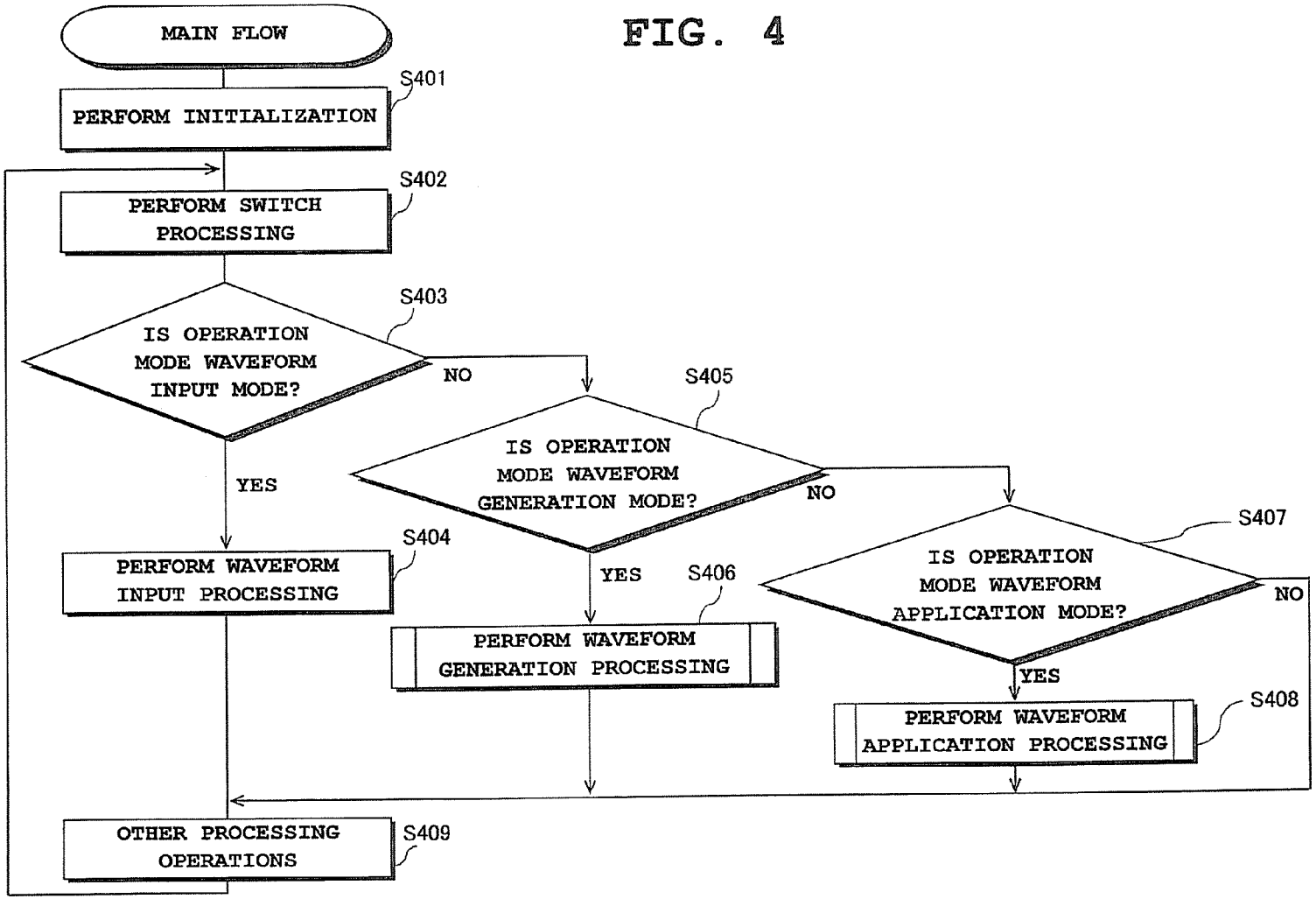
FIG. 4 is a flowchart showing an overview of processing performed by a waveform generation apparatus according to the embodiment.

Hereinafter, operations of a waveform generation apparatus structured as described above will be described. FIG. 4 is a flowchart showing an overview of processing operations performed by the waveform generation apparatus according to the embodiment. As shown in FIG. 4, the CPU 50 first performs initialization, such as resetting the display section 30 and the RAM 70 (Step S401). Next, the CPU 50 receives a switching event from the operating section 20 and performs processing in accordance with the switching event, such as operation mode setting processing (Step S402). The operation modes include waveform input mode, waveform generation mode, and waveform application mode, as described hereafter. In the waveform generation mode, the CPU 50 receives plot conditions used for Takens' plot processing from the operating section 20, and stores them in a predetermined area of the RAM 70.

In switch processing, depression and release of any key constituting the keyboard 40, and the key depression speed are detected. The CPU 50 generates a key-ON event or a key-OFF event based on the detected keyboard information, and outputs it to the sound system 80. Upon receiving a key-ON event, the sound system 80, for example, reads out an original waveform stored in the original waveform data area of the ROM 60 based on pitch information included in the key-ON event, and generates musical sound waveform data. Also, the sound system 80 attaches velocity included in the key-ON event to the musical sound waveform data and outputs the musical sound waveform data. Conversely, upon receiving a key-OFF event, the sound system 80 silences a musical sound at a pitch included in the key-OFF event.

Then, the CPU 50 judges whether or not the operation mode is the waveform input mode (Step S403). When the judgment at Step S403 is YES, the CPU 50 performs the waveform input processing. In the waveform input processing, the CPU 50 instructs the inputting section 10 to start waveform sampling. In response to the instruction, the inputting section 10 samples sound signals inputted from a microphone 11, and after generating original waveform data W(n) (n=0 to N), stores the generated original waveform data in the original waveform data area of the RAM 70.

Figure 5:
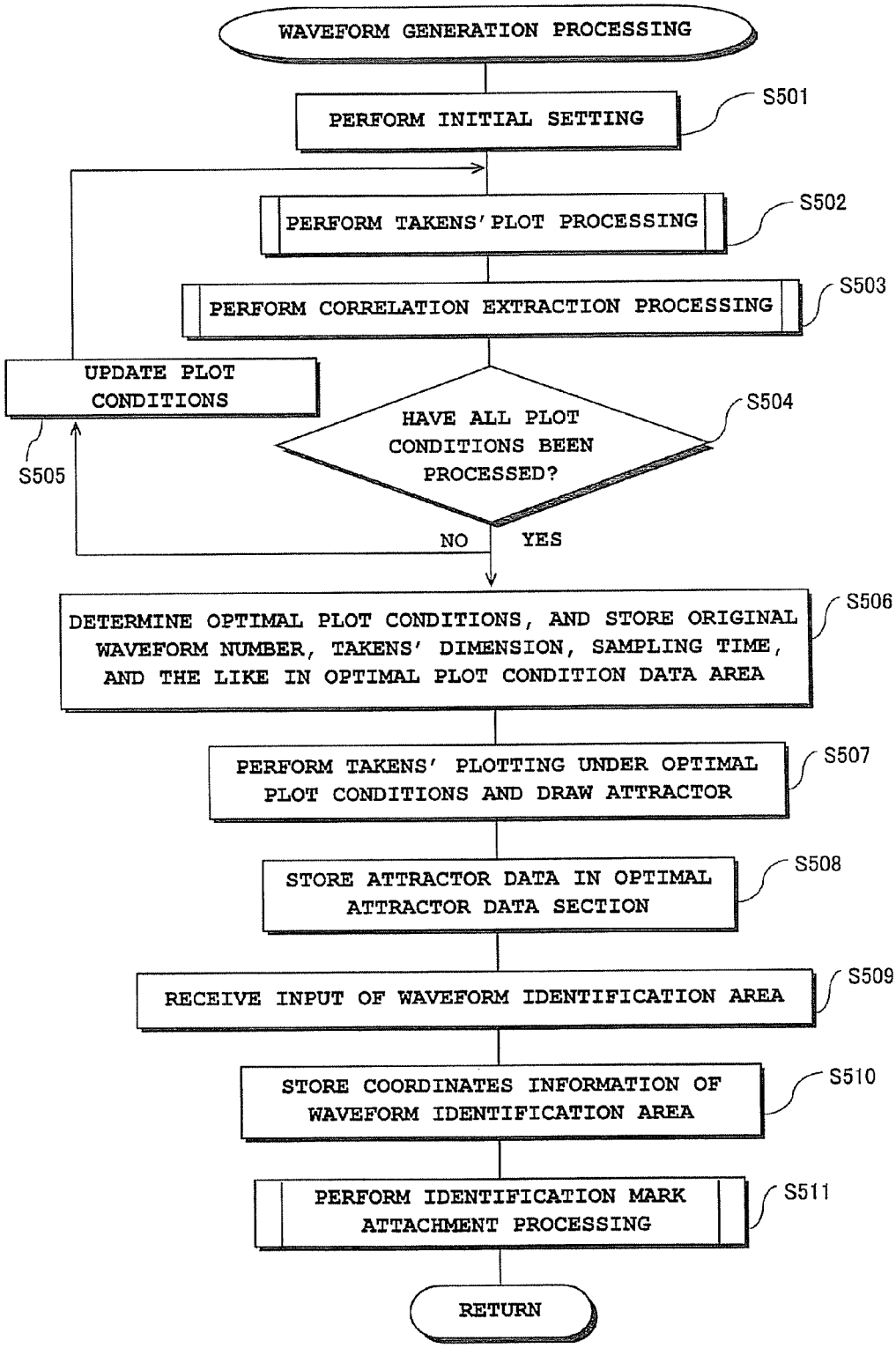
FIG. 5 is a flowchart showing an example of waveform generation processing according to the embodiment.

When the judgment at Step S403 is NO, the CPU 50 judges whether or not the operation mode is the waveform generation mode (Step S405). When the judgment at Step S405 is YES, the CPU 50 performs the waveform generation processing (Step S406). FIG. 5 is a flowchart showing an example of the waveform generation processing according to the embodiment. The waveform generation processing according to the embodiment includes: performing the Takens' plot processing, generating attractor data under optimal plot conditions, and displaying an attractor on the screen of the display section 30 (Step S501 to Step S508 in FIG. 5); the user operating the mouse of the operating section 20 and setting a desired three-dimensional waveform identification area on the screen displaying the attractor (Step S509 and Step S519 in FIG. 5); and acquiring attractor data within the waveform identification area and information associated therewith (Step S511 in FIG. 5).

As shown in FIG. 5, in the waveform generation processing, the CPU 50 first performs initial setting (Step S501). During the initial setting, the CPU 50 clears parameters used for processing in the RAM 70 and data storage areas, and reads out the initial setting values of plot conditions required for Takens' plot (the waveform interval length S time, the plot scale width t, and the resampling time Δt) from the RAM 70.

Next, the CPU 50 performs the Takens' plot processing on original waveform data stored in the original waveform data area of the RAM 70 based on the plot conditions (the waveform interval length S time, the plot scale width t, and the resampling time Δt) (Step S502). In the Takens' plot processing, attractor data is generated from the original waveform data.

Figure 6:
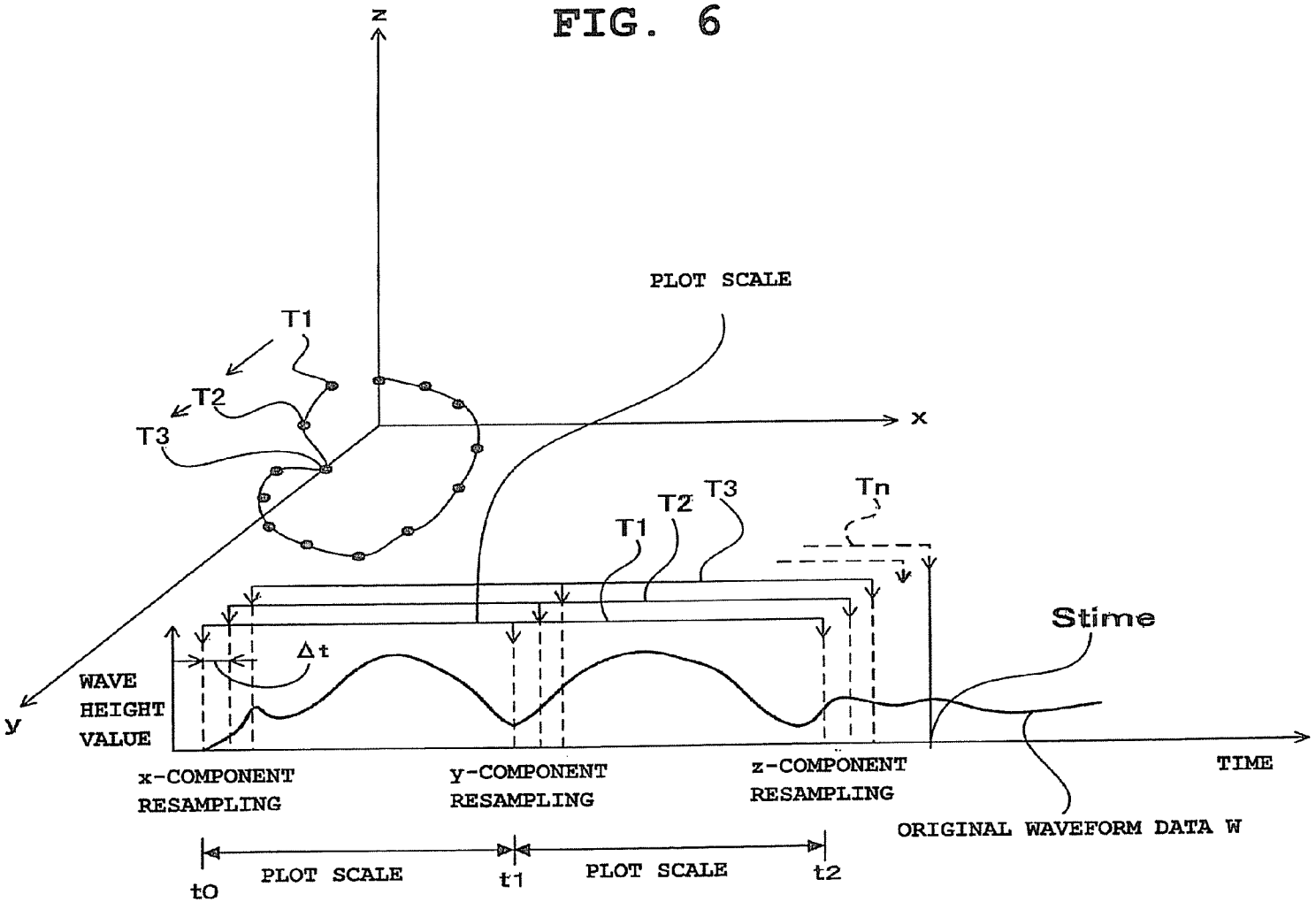
FIG. 6 is a diagram for explaining an overview of Takens' plot processing.

FIG. 6 is a diagram for explaining an overview of the Takens' plot processing. Takens' plot uses a plot scale for resampling original waveform data stored in the original waveform data area of the RAM 70. In the example shown in FIG. 6, a plot sale is shown that is used to generate a three-dimensional attractor from two-dimensional original waveform data (time t and wave height value). This plot scale is specified by a wave height value T (x, y, z) at three points (x-component, y-component, z-component) separated by the plot scale width t.

In FIG. 6, the plot scale specifying the wave height T (x, y, z) of the original waveform data moves in time sequence with every resampling time Δt. The resampling time Δt has a time width that is equal to or more than the sampling cycle of the original waveform data. From the plot scale that moves in time sequence with each resampling time Δt, wave height value T1 (x, y, z) to wave height value Tn (x, y, z) are obtained. The number of the wave height values T1 (x, y, z) to Tn (x, y, z) is determined by the waveform interval length S time.

Figure 7:
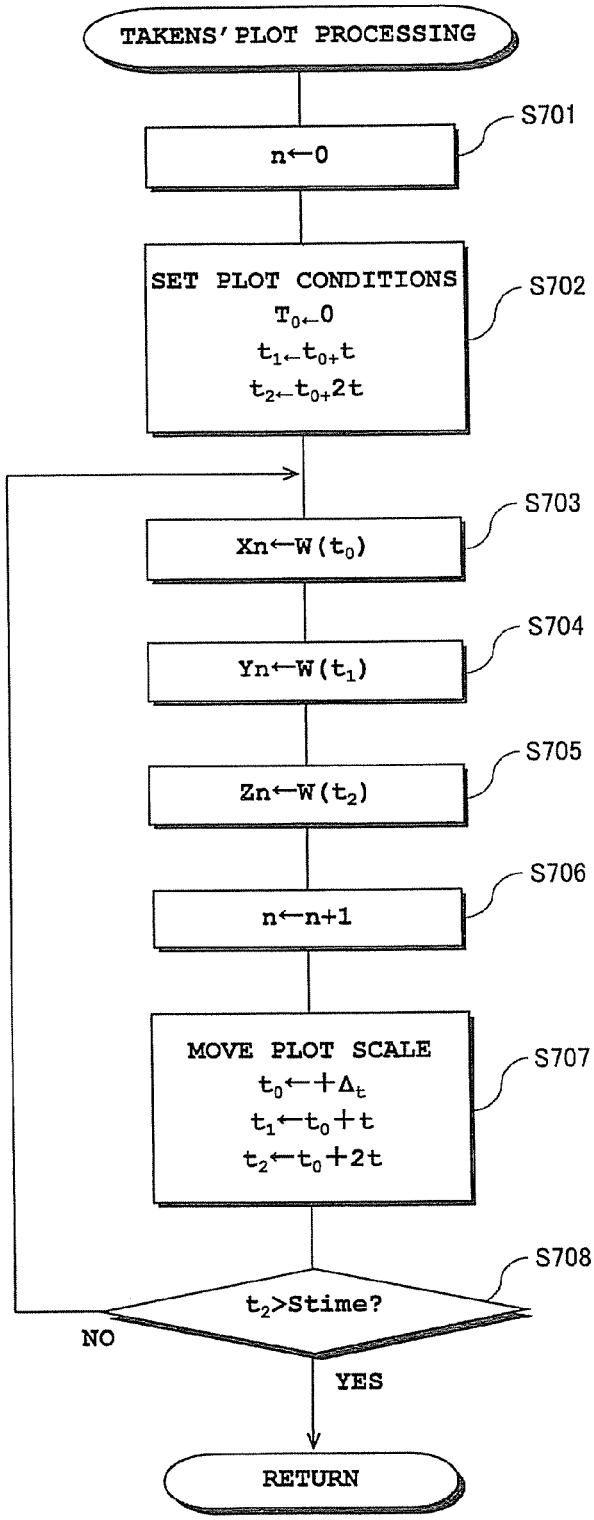
FIG. 7 is a flowchart showing an example of the Takens' plot processing according to the embodiment.

FIG. 7 is a flowchart showing an example of the Takens' plot processing according to the embodiment. As shown in FIG. 7, the CPU 50 resets the variable n to "0" (Step S701) and then calculates the positional relationship of the three points separated by the plot scale width t on the time axis of the original waveform to perform plotting (Step S702). In other words, when $t_0$ that is a first point is determined to be 0, point $t_1$ separated by an amount of time equivalent to the width t, and point $t_2$ separated by an amount of time equivalent to the width t are set.

Then, the CPU 50 stores a wave height value $W(t_0)$ in the position at time $t_0$ as xn within the attractor data area of the RAM 70 (Step S703), stores a wave height value $W(t_1)$ in the position at time $t_1$ as yn (Step S704), and stores a wave height value $W(t_2)$ in the position at time $t_2$ as zn (Step S705). As a result of the processing performed at Step S703 to Step S705, a first three-dimensional coordinate $T_1$ (see FIG. 6) is determined when n=0. Next, the CPU 50 increments the variable n (Step S706), and shifts each plot scale position $t_0$, $t_1$, and $t_2$ on the time axis by an amount equal to Δt (Step S707).

Next, the CPU 50 judges whether or not the time $t_2$ is greater than S time (Step S708). When the judgment at Step S708 is NO, the CPU 50 returns to Step S703 to once again read out the values of the x-component, the y-component, and the z-component, and write the values in the attractor data area of the RAM 70. This operation is repeated until the time $t_2$ exceeds S time. As a result, all wave height values T1 (x, y, z) to Tn (x, y, z) are stored in the RAM 70.

Figure 8:
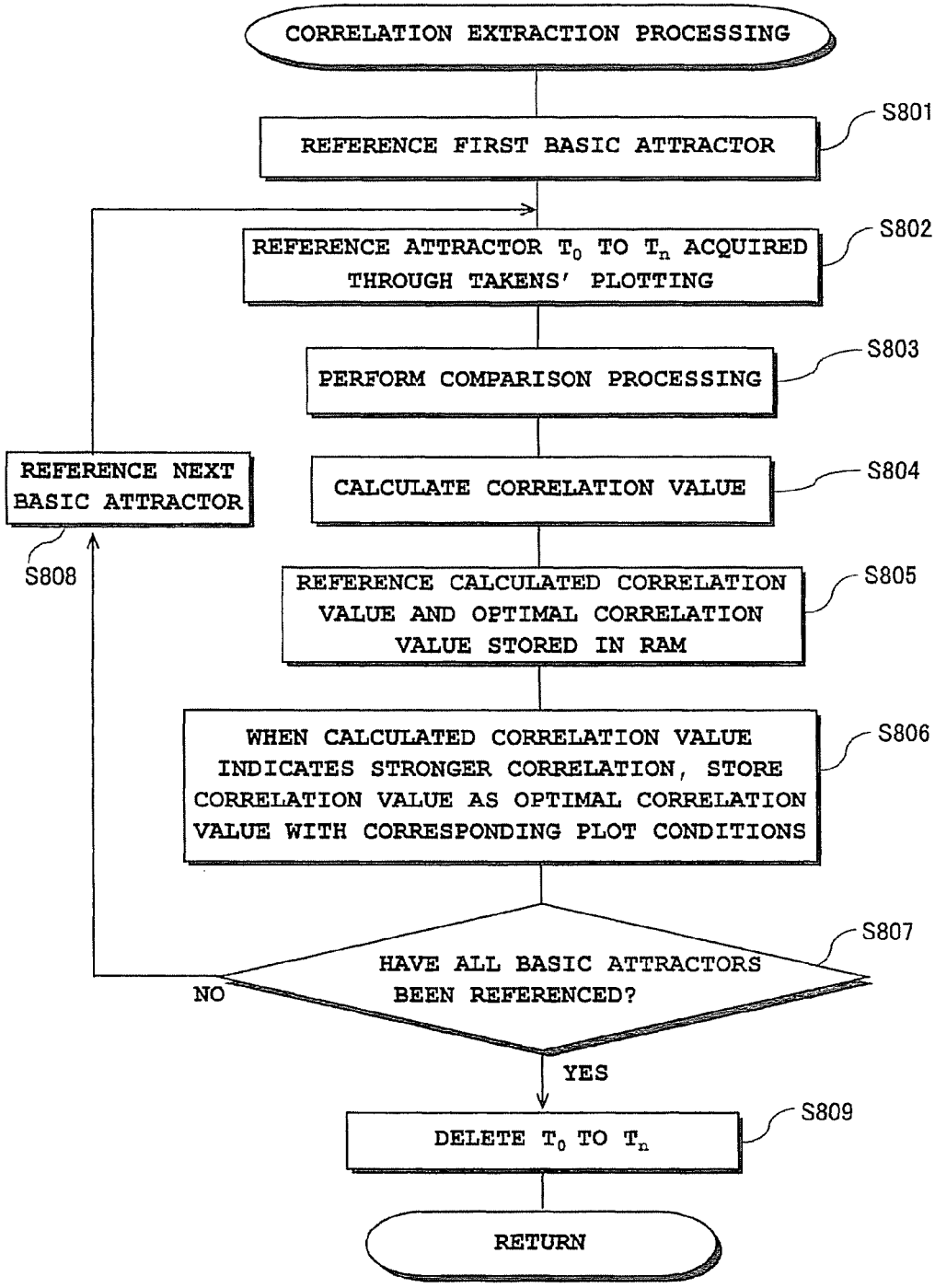
FIG. 8 is a flowchart showing an example of correlation extraction processing according to the embodiment.

Next, the CPU 50 performs correlation extraction processing such that the attractor of the acquired wave height value T1 (x, y, z) to wave height value Tn (x, y, z) is able to most fully express the features (Step S503). FIG. 8 is a flowchart showing an example of the correlation extraction processing according to the embodiment. In the embodiment, data of various basic types of attractors (hereinafter referred to as "basic attractors"), such as "the strange attractor" and "the torus attractor" which are already well-known attractor features, are stored in advance in the basic attractor data area of the ROM 60. In the correlation extraction processing, the correlation between the basic attractors and an attractor acquired through the above-described Takens' plot processing within a three-dimensional phase space is examined, and optimal plot conditions for obtaining the highest correlation are detected.

The CPU 50 reads out a certain basic attractor from among the data of basic attractors stored in the basic attractor data area of the ROM 60 (Step S801). Next, the CPU 50 reads out attractor data acquired through the Takens' plot processing (Step S802), and compares the shapes of the two attractors that have been read out (Step S803).

A known method may be used to compare these shapes at Step S803. For example, the positions, scales, angles, and the like of the two figures may be adjusted and compared from multiple aspects, in a manner similar to fingerprint authentication. Alternatively, the distance of a specific position within each attractor, the direction of the attractor from the position, and the like may be used. The methods are not limited thereto, and other methods, such as figure comparison in a three-dimensional phase space, may also be used.

Next, the CPU 50 decides a correlation value quantitatively indicating the correlation acquired from the comparison of the two figures (Step S804). For example, pixel matching performed in image processing and the like may be used to decide this correlation value. The CPU 50 then compares the calculated correlation value with a value in a correlation value register (optimal correlation value) stored in the work area of the RAM 70.

When the correlation value calculated at Step S804 is greater than the optimal correlation value, the CPU 50 stores in the correlation value register the calculated correlation value and the plot conditions of the attractor acquired through Takens' plot, from which the correlation value has been calculated (Step S805). Then, the CPU 50 judges whether or not all the basic attractors have been referenced (Step S806). When the judgment at Step S807 is NO, the CPU 50 specifies another basic attractor (Step S808) and returns to Step S802.

When the judgment at Step S807 is YES, the CPU 50 deletes the data $T_1$ to $T_n$ in the attractor data area of the RAM 70 in preparation for the next Takens' plot (Step S809). As a result of the correlation extraction processing, a correlation value having the highest correlation with any of the basic attractors and the plot conditions used at that time are stored in the correlation value register. Furthermore, as described hereafter, the Takens' plot processing (Step S502) and the correlation extraction processing (Step S503) are performed under all the plot conditions. Accordingly, among all the plot conditions, the plot conditions and the correlation value of an attractor having the highest correlation with any of the basic attractors are recorded in the correlation value register.

Note that data in the basic attractor data area of the ROM 60 that stores basic attractor data has the same structure as data in the attractor data area, aside from there being no identification mark area 302. Attractor data having more well-known shapes among all the attractors are stored in the basic attractor data area. For example, when the strange attractor is indicated, there is a high possibility of a state of chaos. This state of chaos is very well-known as a state of data found in the natural world, including humans.

When the actual relationship between the features of an attractor and sound is known in advance, a predetermined attractor may be stored in the ROM 60 in advance as a necessary basic attractor, whereby the necessary attractor can be efficiently displayed. When a user discovers an unnamed attractor and finds it to have a significant effect, the attractor can be set as a basic attractor, whereby the number of basic attractors is increased. Furthermore, a configuration may be used in which the user can freely draw a waveform in a phase space displaying an attractor, and the drawn waveform can be used as a basic attractor.

When the correlation extraction processing is completed, the CPU 50 judges whether or not all the plot conditions have been processed (Step S504). When the judgment at Step S504 is NO, the CPU 50 updates the plot conditions and returns to Step S502. When the judgment at Step S504 is YES, the CPU 50 determines that the plot conditions stored in the correlation value register are optimal plot conditions, and stores the original waveform number and the plot conditions (the Takens' dimension number, the plot scale t, the sampling time Δt, the waveform interval length S time, and the coordinate information) in the plot condition data section (refer to reference number 210) of the optimal plot condition data area in the RAM 70 (Step S506).

Figure 9:
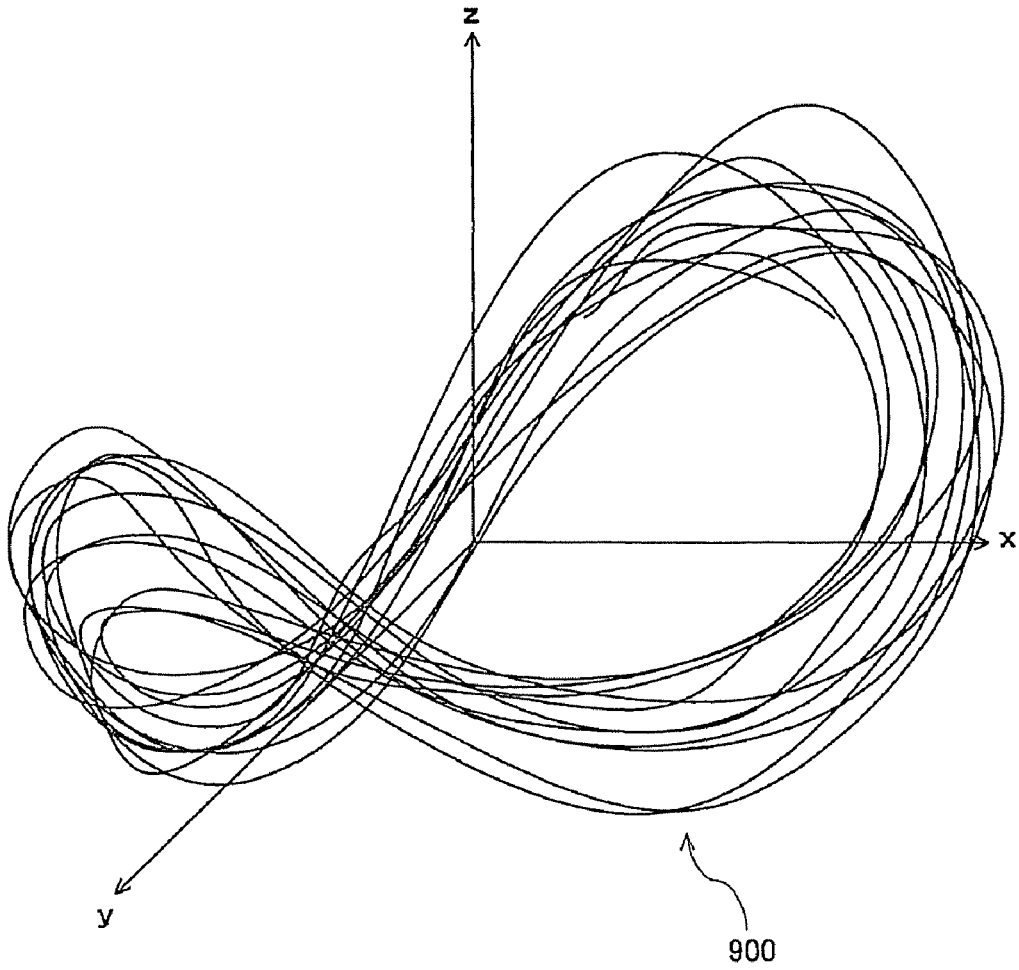
FIG. 9 is a diagram showing an example of an attractor displayed on a screen of a display section.

The CPU 50 displays on the screen of the display section 30 an image created by the wave height value T1 (x, y, z) to wave height value Tn (x, y, z) that are the coordinate values of the attractor determined by Takens' plot under the optimal plot conditions being plotted in a three-dimensional phase space (Step S507). FIG. 9 is a diagram showing an example of an attractor displayed on the screen of the display section. An attractor 900 shown in FIG. 9 is an attractor under plot conditions having the highest correlation with any of the basic attractors. This attractor 900 has a trajectory shape. Note that, in order for the trajectory of an attractor to be clearly shown when it is displayed, the plotted point and the following point may be clearly displayed as a light colored line by performing spline processing or the like. Next, the CPU 50 stores the data of the drawn attractor in the optimal attractor data section 202 of the optimal plot condition data area in the RAM 70 (Step S508).

Figure 10:
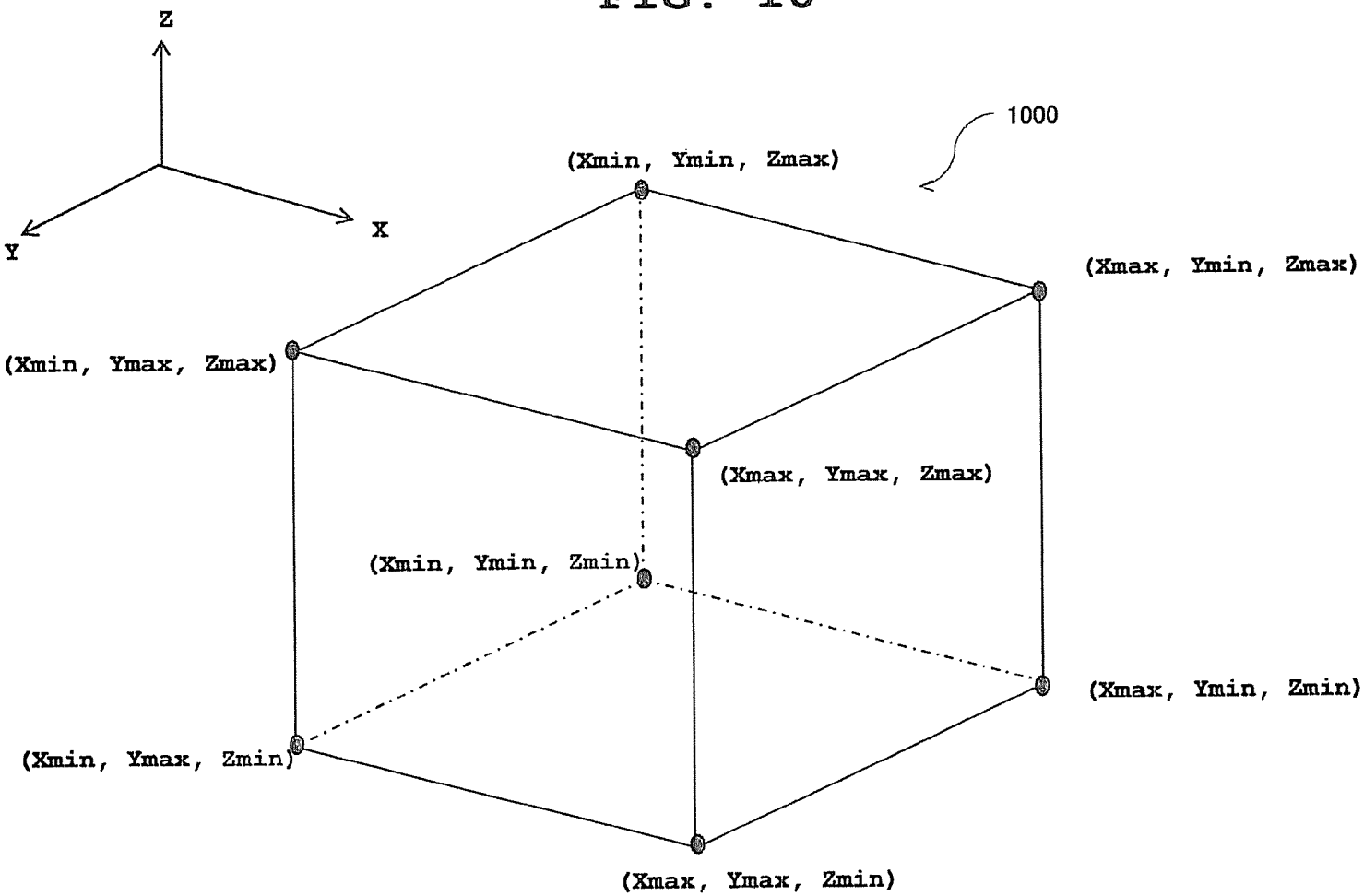
FIG. 10 is a diagram showing an example of coordinate values of a rectangular area.
Figure 11:
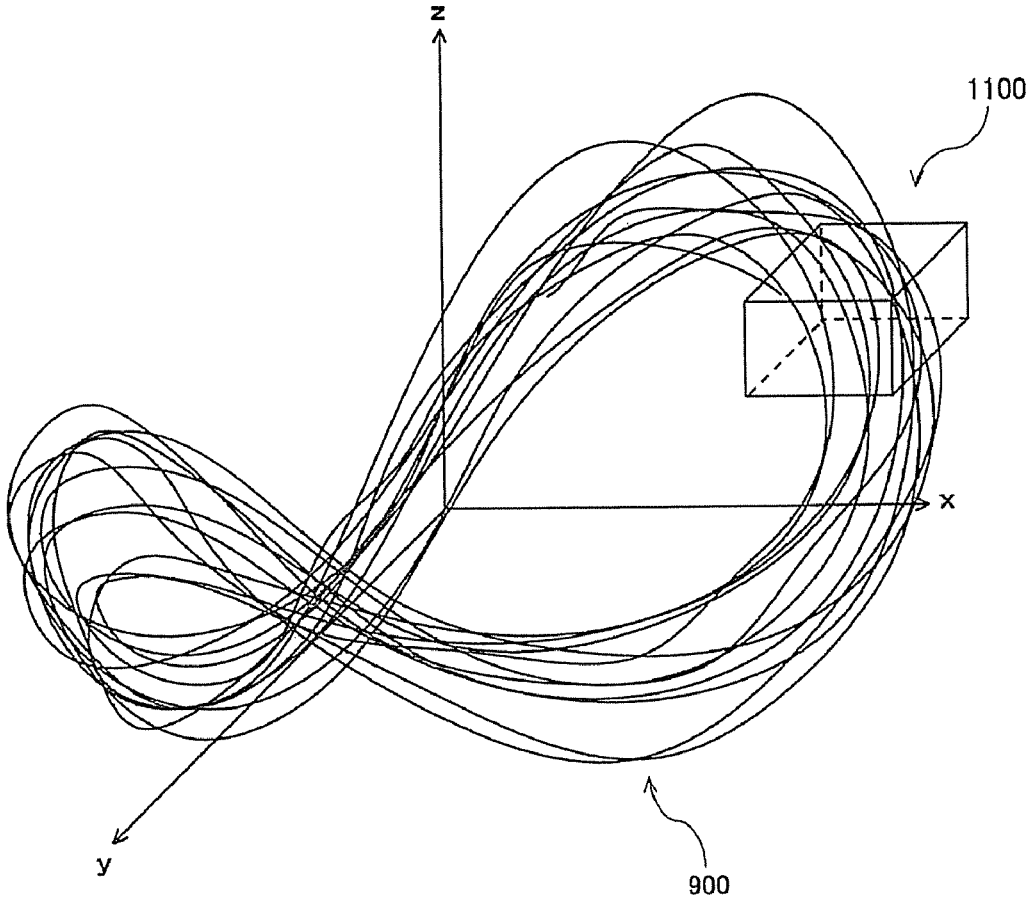
FIG. 11 is a diagram showing a state in which a rectangular area (waveform identification area) is disposed in the drawn attractor.

The user operates the mouse of the operating section 20 and draws an intended rectangular area in the displayed attractor. FIG. 10 is a diagram showing an example of the coordinate values of a rectangular area. This rectangular area serves as a waveform identification area for specifying the area of an identified waveform. FIG. 11 is a diagram showing a state in which a rectangular area (waveform identification area) has been arranged in the drawn attractor. As shown in FIG. 10, a rectangular area 1000 is an area specified by a minimum value Xmin and a maximum value Xmax of the X coordinate, a minimum value Ymin and a maximum value Ymax of the Y coordinate, and a minimum value Zmin and a maximum value Zmax of the Z coordinate. As shown in FIG. 11, the user is able to arrange a rectangular area 1100 of an intended size to include a predetermined portion of the trajectory of the attractor 900. The size and location of the rectangular area can be set as intended by desired.

Figure 12:
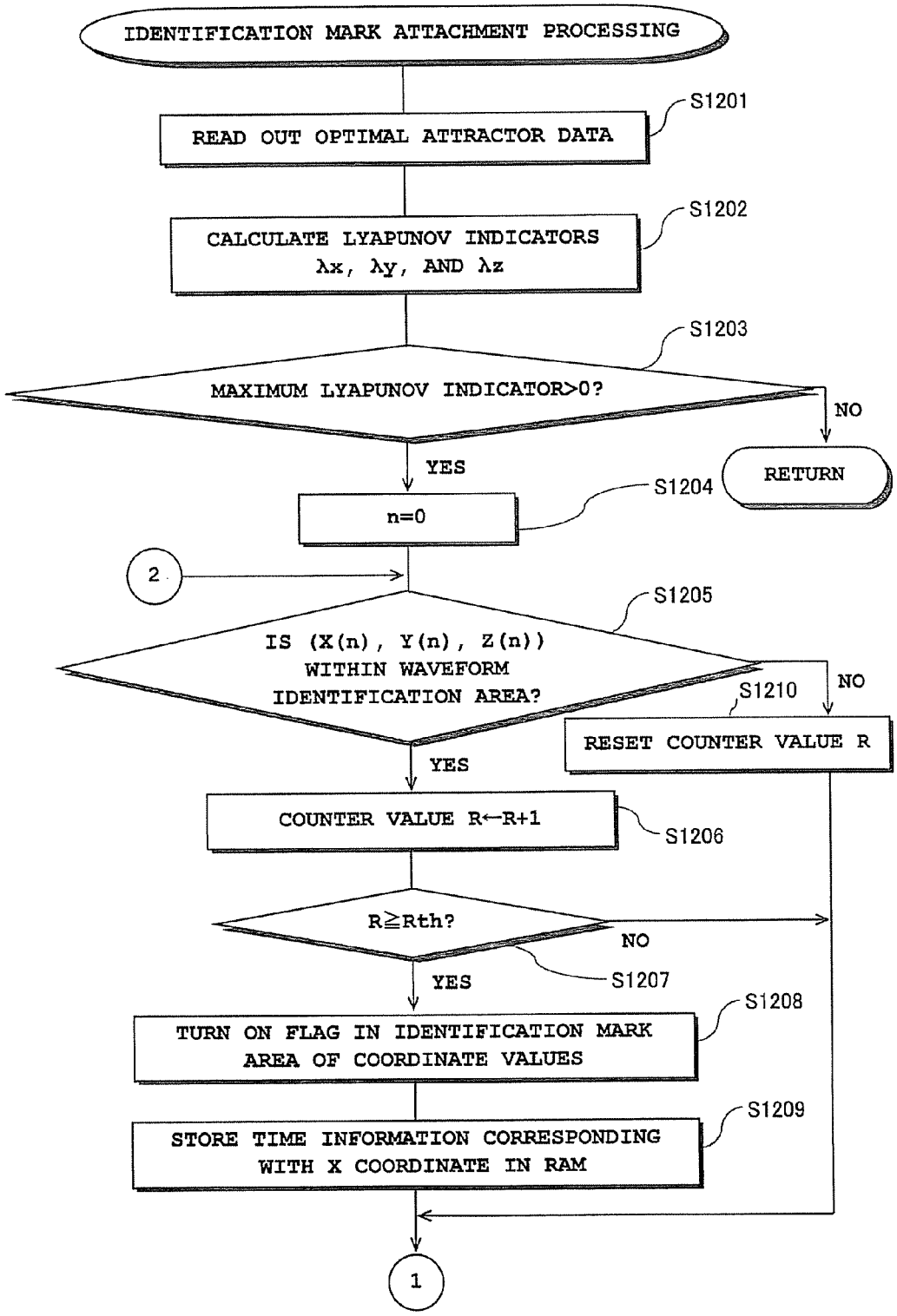
FIG. 12 is a flowchart of an example of identification mark attachment processing according to the embodiment.
Figure 13:
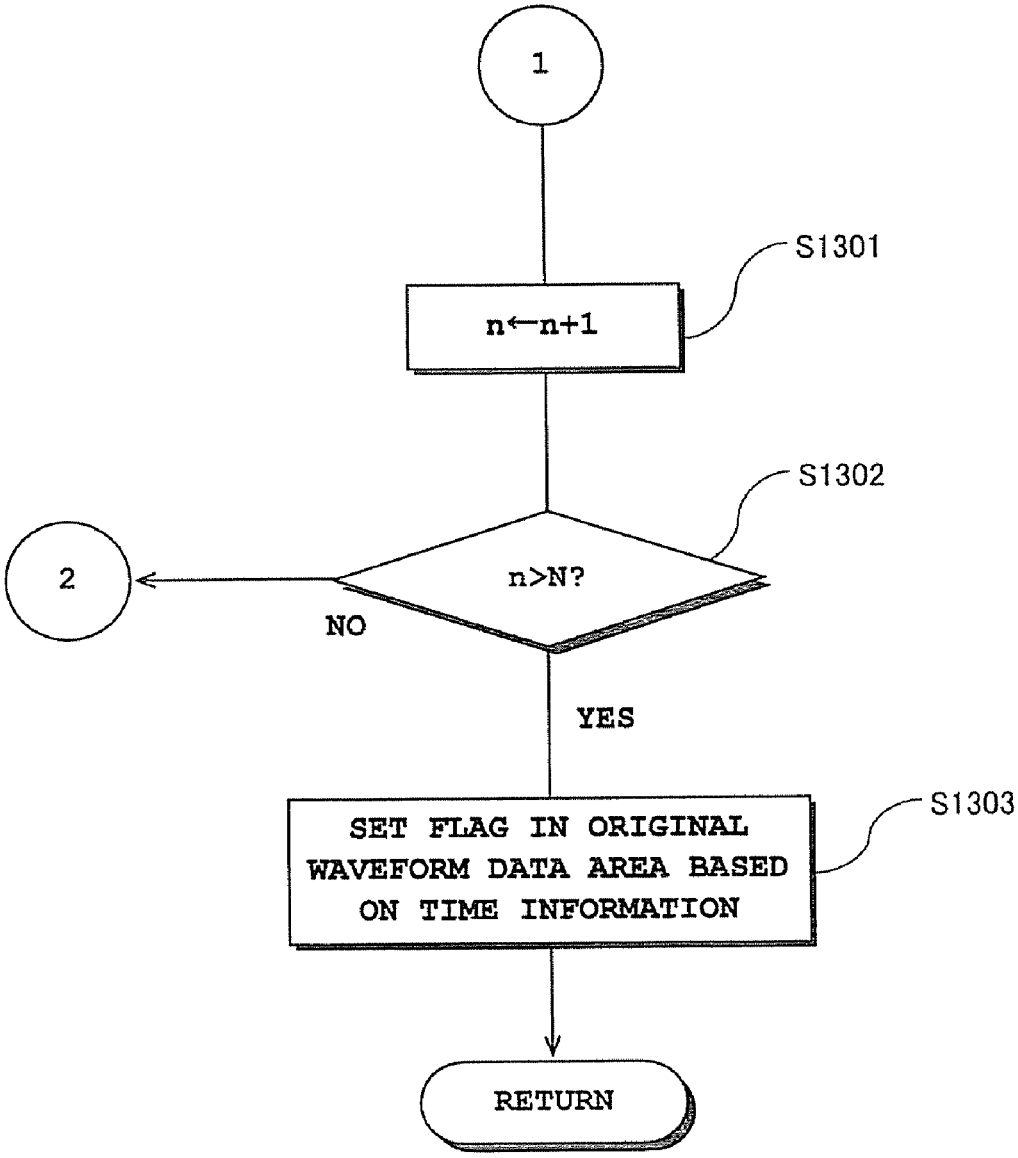
FIG. 13 is a flowchart of an example of the identification mark attachment processing according to the embodiment.

The CPU 50 receives information on a rectangular area serving as a waveform identification area from the operating section 20 (Step S509) and stores the coordinate information (the minimum value Xmin and the maximum value Xmax of the X coordinate, the minimum value Ymin and the maximum value Ymax of the Y coordinate, and the minimum value Zmin and the maximum value Zmax of the Z coordinate) in the RAM 70 (Step S510). The CPU 50 then performs identification mark attachment processing (Step S511). FIG. 12 and FIG. 13 are flowcharts showing an example of the identification mark attachment processing according to the embodiment.

As shown in FIG. 12, the CPU 50 reads out the optimal attractor data from the optimal attractor data section 202 (Step S1201), and then calculates Lyapunov indicators λx, λy, and λz respectively for the coordinate values X, Y and Z.

When the trajectory is xn, the Lyapunov indicator is expressed as follows.

$$\lambda = \lim_{N\to\infty} (1/N) \sum_{N=1}^{N} \log\left|\frac{dx_{n+1}}{dx_n}\right| \qquad \text{[Equation 1]}$$

Note that, in the calculation, the approximation value should be calculated with N as a sufficiently large predetermined number. The CPU 50 sets the maximum values of the Lyapunov indicators λx, λy, and λz as a maximum Lyapunov indicator Maxλ. Next, the CPU 50 judges whether or not the maximum Lyapunov indicator Maxλ is a positive value (Step S1203). When the judgment at Step S1203 is YES, the CPU 50 resets the parameter n for specifying the attractor data to "0" (Step S1204) and judges whether or not the attractor data (X(n), Y(n), Z(n)) is within the waveform identification area (Step S1205).

When the judgment at Step S1205 is YES, the CPU 50 increments a counter value R indicating the number of times attractor data consecutively present within the waveform identification area (Step S1206) and judges whether or not the counter value R is equal to or more than a threshold value Rth (Step S1207). When the judgment at Step S1207 is YES, the CPU 50 sets a flag of the identification mark area associated with the coordinate values in the attractor data to "1" (Step S1208). In addition, the CPU 50 acquires time information corresponding to the X coordinate and stores the acquired time information in the RAM 70 (Step S1209).

Next, the CPU 50 increments the parameter n and judges whether or not the parameter n is greater than the number of data N of the attractor data (Step S1302). When the judgment at Step S1302 is NO, the CPU 50 returns to Step S1205. When the judgment at Step S1302 is YES, the CPU 50 sets an identification flag associated with the time information in the original waveform data area to "1" based on the time information within the RAM 70 (Step S1303).

When the judgment at Step S1203 is NO, the CPU 50 terminates the processing operation. When the judgment at Step S1205 is NO, the CPU 50 resets the counter value R to "0" and proceeds to Step S1301.

FIG. 14 is a diagram for explaining the acquisition of time information in the identification mark attachment processing according to the embodiment. In FIG. 14, attractor data from X(p) to X(p+q) are within the waveform identification area (see value "1" of reference number 1401). X(m) ($0 \leqq m \leqq N$) is equivalent to the wave height value $W(t_0+m\Delta t)$. Therefore, the coordinate values of the X coordinate within the waveform identification area are $W(t_0+p\Delta t)$ to $W(t_0+(p+q)\Delta t)$ (see reference number 1402). Therefore, the time information corresponding to the X coordinate is $t_0+p\Delta t$ to $t_0+(p+q)\Delta t$ (reference number 1410). In the identification mark attachment processing, time information corresponding to attractor data included in the waveform identification area is acquired in this way.

Figure 15:
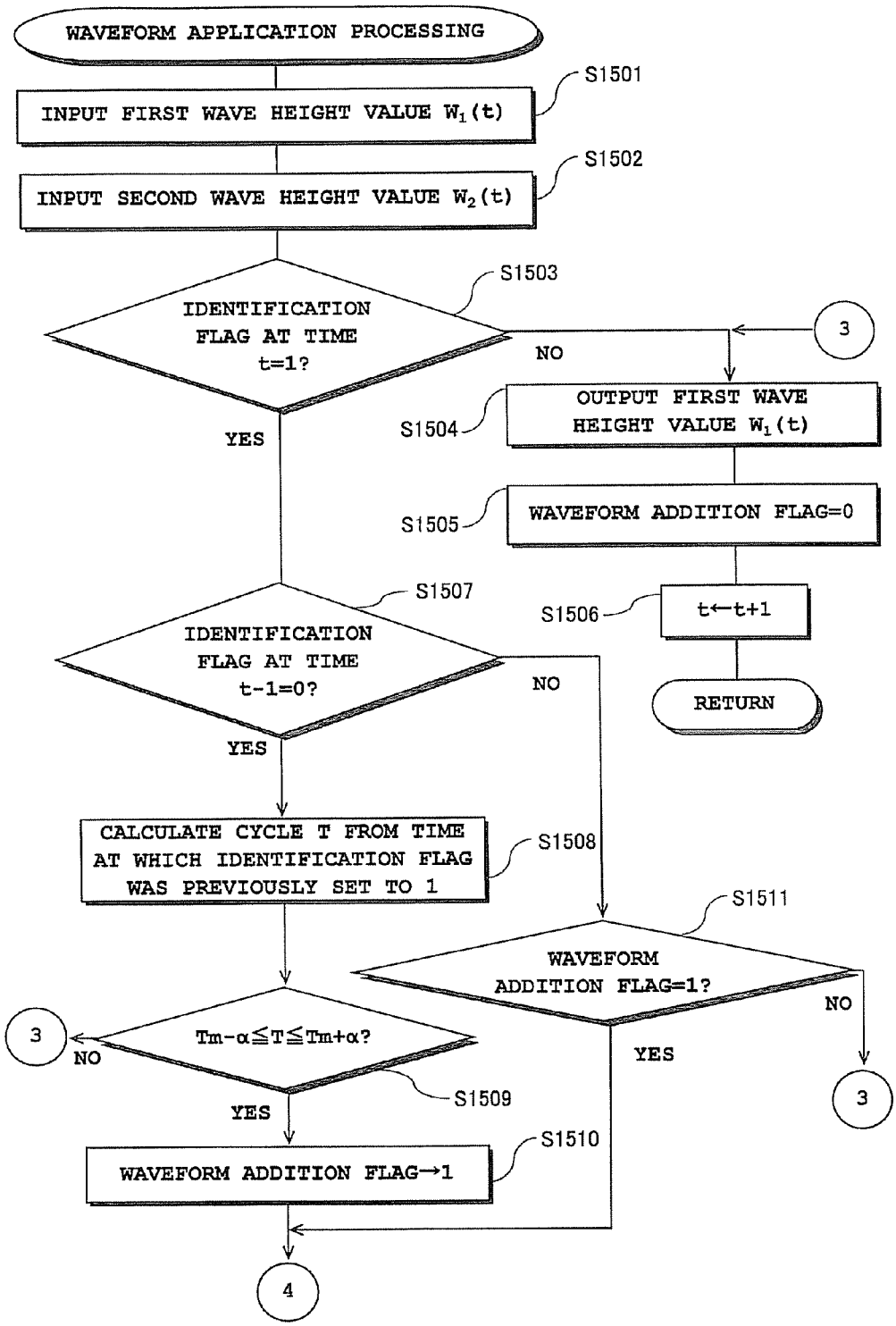
FIG. 15 is a flowchart of an example of waveform application processing according to the embodiment.
Figure 16:
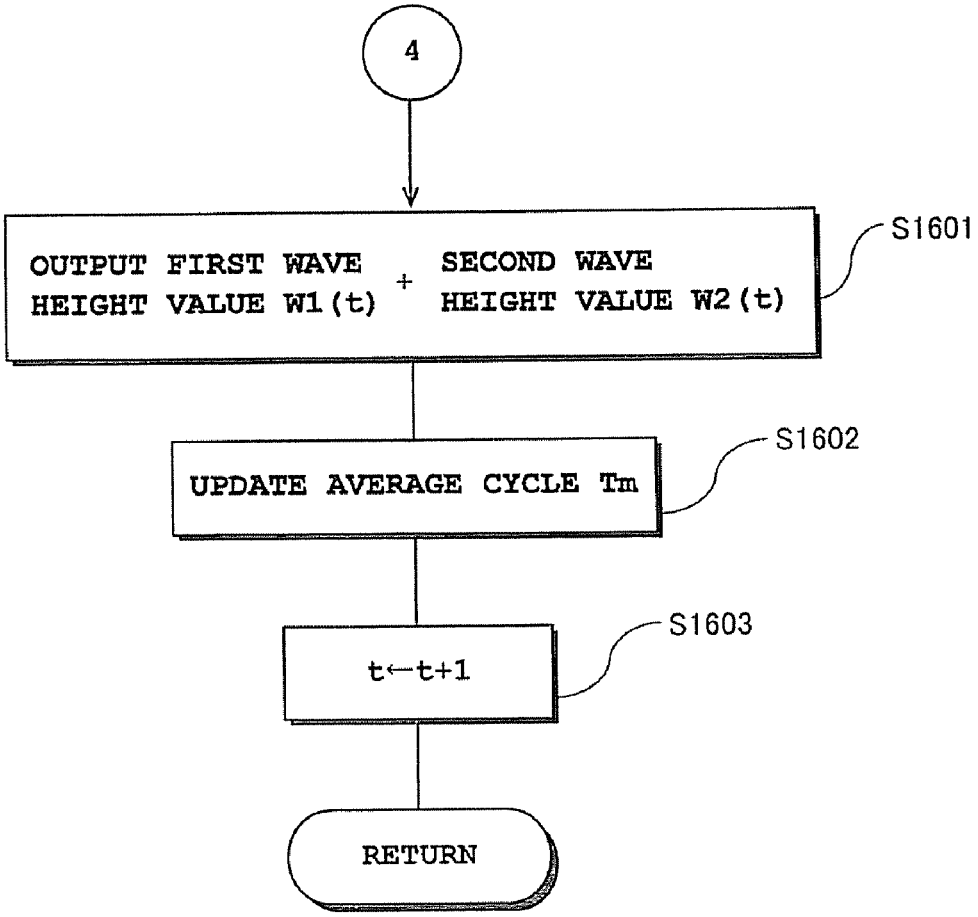
FIG. 16 is a flowchart of an example of the waveform application processing according to the embodiment.

In FIG. 4, when the judgment at Step S405 is NO, the CPU 50 judges whether or not the operation mode is the waveform application mode (Step S407). When the judgment at Step S407 is YES, the CPU 50 performs the waveform application processing (Step S408). FIG. 15 and FIG. 16 are flowcharts showing an example of the waveform application processing according to the embodiment.

In the embodiment, waveform data stored in the original waveform data area is a first waveform data. In addition, at a timing indicated by time information corresponding to attractor data included in a waveform identification area acquired through the identification mark attachment processing, another waveform data (a second waveform data) is applied to the first waveform data (the original waveform data), and composite waveform data of the first waveform data and the second waveform data is outputted.

The waveform data constantly outputted is referred to as the first waveform data, and the wave height value thereof is referred to as a first wave height value. The other waveform data that is applied to the first waveform data at the above-described timing is referred to as the second waveform data, and the wave height value thereof is referred to as a second wave height value.

First, the CPU 50 reads out a wave height value $W_1(t)$ of the first waveform data from the RAM 70 (Step S1501). Note that a configuration may be used in which the wave height value $W_1(t)$ of the first waveform data is read out from the RAM 70 by a note-ON event of the keyboard 40.

Further note that "t" is a parameter indicating time, and is initially set to "0" and then incremented as described hereafter in the waveform application processing. Next, the CPU 50 reads out a wave height value $W_2(t)$ of the second waveform data from the RAM 70 (Step S1502). The second waveform data may be new waveform data prepared for waveform application. For example, this waveform data may be waveform data read out from the RAM 70, or waveform data acquired through the microphone 12 and the inputting section 10.

Next, the CPU 50 references the original waveform data area of the first waveform data and judges whether or not the identification flag at time t is "1" (Step S1503). When the judgment at Step S1503 is NO, the CPU 50 outputs only the first wave height value $W_1(t)$ to the sound system 80 (Step S1504). In addition, the CPU 50 resets a waveform addition flag in the RAM 70 to "0" (Step S1505) and increments the parameter t indicating time (Step S1506).

When the judgment at Step S1503 is YES, the CPU 50 references the original waveform data area and judges whether or not the identification flag at time (t−1) is "0" (Step S1507). When the judgment at Step S1507 is YES, the CPU 50 calculates a cycle T between the time at which the identification flag has been set to "1" last time for the first time and the time t (Step S1508). Next, the CPU 50 judges whether or not the cycle T is within a predetermined range of an average cycle Tm, or in other words, whether or not $Tm-\alpha \leqq T \leqq Tm+\alpha$ ($\alpha$ is a predetermined positive constant) (Step S1509). When the judgment at Step S1509 is YES, the CPU 50 sets the waveform addition flag in the RAM 70 to "1".

When the judgment at Step S1507 is NO, the CPU 50 judges whether or not the waveform addition flag is "1" (Step S1511). When the judgment at Step S1511 is NO, the CPU 50 proceeds to Step S1504. Accordingly, in this instance, only the first waveform data is outputted.

When the judgment at Step S1511 is YES, or after Step S1510 is performed, the CPU 50 adds the first wave height value $W_1(t)$ and the second wave height value $W_2(t)$, and outputs the sum to the sound system 80 (Step S1601). Then, the CPU 50 updates the average cycle Tm taking into consideration the newly calculated cycle T (Step S1602) and increments the parameter t indicating time (Step S1603). After the waveform input processing (Step S404), the waveform generation processing (Step S406), and the waveform application processing (Step S408) are performed as described above, the CPU 50 performs other processing operations, such as updating the image displayed in the display section 30, and returns to Step S402.

Figure 17A:
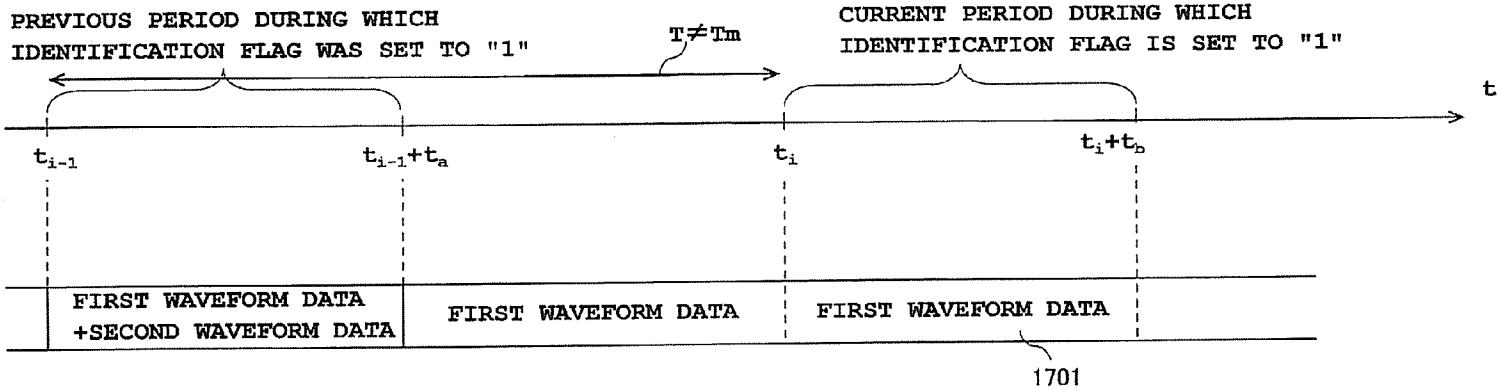
FIG. 17A is a diagram of an example of a waveform outputted by the waveform application processing.
Figure 17B:
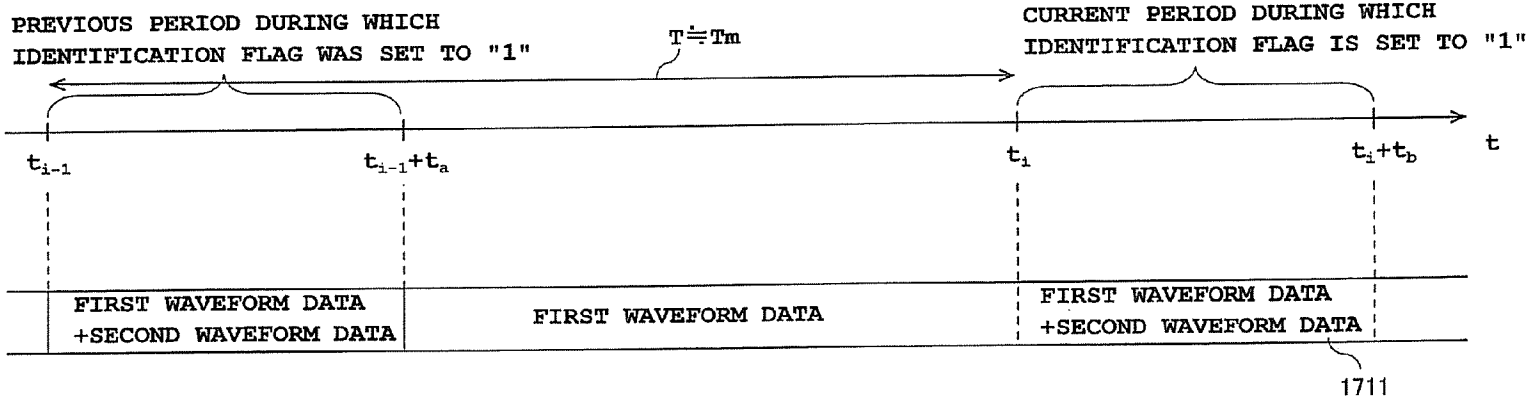
FIG. 17B is a diagram of an example of a composite waveform outputted by the waveform application processing.

FIG. 17A and FIG. 17B are diagrams showing an example of a waveform outputted by the waveform application processing. In the example shown in FIG. 17A, an instance is considered where a waveform to be outputted during a period in which the current identification flag is "1" is determined. At Step S1508, the cycle T ($T=t_i-t_{i-1}$) is calculated which is the difference of the time $t_{i-1}$ at which the identification flag has been set to "1" last time and the time $t_i$ at which the identification flag has been set to"1" this time. In the example in FIG. 17A, T is not within the range of $Tm\pm\alpha$ (NO at Step S1509). Therefore, only the first waveform data is outputted during the period of time $t_i$ to $t_i+t_b$ in which the identification flag is "1" as well (see FIG. 17A reference number 1701).

In the example shown in FIG. 17B, at Step S1508, the cycle T ($T=t_i-t_{i-1}$) is calculated which is the difference of the time $t_{i-1}$ at which the identification flag has been set to "1" last time and the time $t_i$ at which the identification flag has been set to "1" this time. In the example in FIG. 17B, T is within the range of $Tm\pm\alpha$ ($T\approx Tm$: YES at Step S1509). Therefore, composite waveform data of the first waveform data and the second waveform data is outputted during the period of time $t_i$ to $t_i+t_b$ in which the identification flag is "1" (see FIG. 17B reference number 1711). The first waveform data, or the composite waveform data of the first waveform data and the second waveform data is provided to the sound system 80, and after being converted to analog sound signals by the sound system 80, outputted from a speaker (not shown).

In the embodiment, an image including an at tractor trajectory based on attractor data acquired through the Takens' plot processing is displayed on the screen of the display section 30, whereby the user can operate the inputting section 10 to set an intended waveform identification area in the image. The CPU 50 acquires the coordinate values of the portion of the attractor trajectory included in the waveform identification area as coordinate values belonging to the waveform identification area, and acquires time information equivalent to the coordinate values as identification time information. When outputting original waveform data that is the first waveform data is outputted, if the time of the first waveform data is included in the identification time information, the CPU 50 generates composite waveform data that is the sum of the wave height value of the first waveform data and a wave height value at a time corresponding to the second waveform data that is a predetermined additional waveform. Therefore, according to the embodiment, waveform resonation and amplification by the addition of a waveform where chaos has been taken into consideration is actualized, rather than simple waveform resonation and amplification.

Additionally, in the embodiment, the CPU 50 acquires, when a predetermined number of coordinates configuring an attractor trajectory are consecutively included in a waveform identification area, the coordinate values of the consecutive coordinates as coordinate values belonging to the waveform identification area. As a result, coordinate values are determined to be belonging to a waveform identification area only when a trajectory of a certain length passes through the waveform identification area.

Moreover, in the embodiment, the CPU 50 calculates the maximum Lyapunov indicator of an attractor data and acquires, when the maximum Lyapunov indicator is a positive value, the coordinate values of the portion of an attractor trajectory included in the waveform identification area, as coordinate values belonging to the waveform identification area. As a result, only coordinate values in a state of chaos can be acquired as coordinate values belonging to a waveform identification area.

Furthermore, in the embodiment, when the time indicated in identification time information is cyclic, the CPU 50 generates composite waveform data that is the sum of the wave height value of the first waveform data and a wave height value at a time corresponding to the second waveform data that is a predetermined additional waveform. As a result, cyclic waveforms can be combined with chaos being maintained.

Still further, in the embodiment attractor data is generated that is based on each of a plurality of different plot conditions in which at least one of the plot scale t and the resampling time Δt has been changed in the Takens' plot processing. In addition, a correlation value between each of a plurality of attractor data generated by the Takens' plot processing means and basic attractor data stored in the storage means is extracted, and the attractor trajectory of attractor data generated based on plot conditions having the highest correlation value is displayed on the screen of a display device. As a result, an attractor trajectory having higher chaos characteristics can be acquired.

The present invention is not limited to the above-described embodiment. Various modifications can be made without departing from the scope of the invention described in the claims, and are included within the scope of the present invention.

While the present invention has been described with reference to the preferred embodiments, it is intended that the invention be not limited by any of the details of the description therein but includes all the embodiments which fall within the scope of the appended claims.

What is claimed is:

1. A waveform generation apparatus comprising:

a Takens' plot processing means for expanding a coordinates information group to show original waveform data upon a two-dimensional phase space having a time axis and a wave height value axis to an n-dimensional phase space (n>2) including a time axis and a wave height value axis by using Takens' embedding theorem, and converting the coordinates information group consecutively to show an attractor data upon the n-dimensional phase space;

an area demarcation means for demarcating a predetermined area upon the n-dimensional phase space;

a time information acquisition means for acquiring the coordinates information group consecutively that belongs to a demarcated area, specifying one of the coordinates information from among the coordinates information group consecutively acquired and acquiring coordinate values corresponding to the time axis within the coordinates information as time information; and a waveform outputting means for, while outputting the original waveform data, generating and outputting a composite waveform data by adding a predetermined waveform data to the original waveform data from a position of the original waveform data upon the time axis corresponding to the acquired time information.

2. The waveform generation apparatus according to claim 1, wherein the time information acquisition means specifies the coordinates information in which a preceding coordinates information does not belong in the demarcated area from among the coordinates information group consecutively acquired, only when a predetermined number of the coordinates information following the coordinates information in which the preceding coordinates information does not belong in the demarcated area is consecutively included in the demarcated area by the area demarcation means, and acquires the coordinate values corresponding to the time axis within the coordinates information as the time information.

3. The waveform generation apparatus according to claim 1, wherein the time information acquisition means calculates a maximum Lyapunov indicator of the attractor data;

specifies the coordinates information in which the preceding coordinates information does not belong in the demarcated area from among the coordinates information group consecutively acquired only when the maximum Lyapunov indicator is a positive number; and acquires the coordinate values corresponding to the time axis within the coordinates information as the time information.

4. The waveform generation apparatus according to claim 1, wherein the time information acquisition means acquires a plurality of coordinates information groups consecutively which belong to the demarcated area, specifies one of the coordinates information from each of the coordinates information groups consecutively acquired, and acquires the coordinate values corresponding to the time axis within each of the specified coordinates information as time information; and wherein the waveform outputting means generates and outputs the composite waveform data by adding the predetermined waveform data to the original waveform data from each position of the original waveform data upon a time axis corresponding to each of the acquired time information, when a judgment is made that a cyclic characteristic is present between each of the acquired time information.

5. The waveform generation apparatus according to claim 1, further comprising:

an attractor image generation means for displaying an attractor image showing the attractor data generated by the Takens' plot processing means on a display screen of a display means;

wherein the area demarcation means specifies an area within the image displayed on the display screen using a predetermined input device.

6. The waveform generation apparatus according to claim 1, wherein the Takens' plot processing means generates the attractor data by plotting a wave height value of the original waveform data based on predetermined plot conditions including a plot scale t and a resampling time Δt, and sequentially expanding the wave height value plotted in a corresponding coordinate position upon the n-dimensional phase space.

7. A non-transitory computer-readable storage medium having stored thereon a waveform generation program that is executable by a computer, the program being executable by the computer to perform functions comprising:

Takens' plot processing which expands a coordinates information group to show original waveform data upon a two-dimensional phase space having a time axis and a wave height value axis to an n-dimensional phase space (n>2) including a time axis and a wave height value axis by using Takens' embedding theorem, and converts the coordinates information group consecutively to show an attractor data upon the n-dimensional phase space;

area demarcation processing which demarcates a predetermined area upon the n-dimensional phase space;

time information acquisition processing which acquires the coordinates information group consecutively that belongs to a demarcated area, specifies one of the coordinates information from among the coordinates information group consecutively acquired and acquires coordinate values corresponding to the time axis within the coordinates information as time information; and waveform output processing, while outputting the original waveform data, generates and outputs a composite waveform data by adding a predetermined waveform data to the original waveform data from a position of the original waveform data upon the time axis corresponding to the acquired time information.

* * * * *